US007059425B2

(12) United States Patent
Ikuta

(10) Patent No.: US 7,059,425 B2
(45) Date of Patent: Jun. 13, 2006

(54) RECIPROCATING POWER TOOL

(75) Inventor: Hiroki Ikuta, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 10/754,737

(22) Filed: Jan. 9, 2004

(65) Prior Publication Data

US 2004/0194986 A1 Oct. 7, 2004

(30) Foreign Application Priority Data

Jan. 10, 2003 (JP) ..... 2003-005144

(51) Int. Cl.
*B25D 11/12* (2006.01)

(52) U.S. Cl. ..... 173/128; 173/216; 173/117

(58) Field of Classification Search ..... 173/216, 173/11, 201, 49, 128, 261, 117, 118, 217
See application file for complete search history.

(56) References Cited

U.S. PATENT DOCUMENTS

| | | | | |
|---|---|---|---|---|
| 634,194 | A | 10/1899 | Woodward | |
| 3,650,336 | A * | 3/1972 | Koehler | 173/110 |
| 4,222,443 | A | 9/1980 | Chromy | |
| 5,775,440 | A * | 7/1998 | Shinma | 173/109 |
| 5,806,609 | A * | 9/1998 | Stock et al. | 173/205 |
| 5,879,111 | A * | 3/1999 | Stock et al. | 408/6 |
| 6,044,918 | A * | 4/2000 | Noser et al. | 173/176 |
| 6,286,611 | B1 * | 9/2001 | Bone | 173/216 |
| 6,431,290 | B1 * | 8/2002 | Muhr et al. | 173/201 |
| 6,484,814 | B1 * | 11/2002 | Bongers-Ambrosius | 173/2 |
| 6,520,266 | B1 * | 2/2003 | Bongers-Ambrosius et al. | 173/2 |
| 6,557,648 | B1 * | 5/2003 | Ichijyou et al. | 173/48 |
| 6,745,850 | B1 * | 6/2004 | Hahn | 173/132 |
| 2002/0056558 | A1 * | 5/2002 | Bongers-Ambrosius et al. | 173/201 |
| 2002/0170186 | A1 | 11/2002 | Sakaguchi | |

FOREIGN PATENT DOCUMENTS

| | | |
|---|---|---|
| DE | 35 05 544 A1 | 8/1986 |
| DE | 40 38 586 A1 | 6/1992 |
| EP | 0 063 725 A2 | 11/1982 |
| EP | 0 560 512 A1 | 9/1993 |
| JP | 51-6583 | 1/1976 |
| JP | 4-31801 | 11/1989 |

* cited by examiner

*Primary Examiner*—Stephen F. Gerrity
*Assistant Examiner*—Paul Durand
(74) *Attorney, Agent, or Firm*—Lahive & Cockfield, LLP; Anthony A. Laurentano, Esq.

(57) ABSTRACT

It is an object of the present invention to provide a reciprocating power tool having a further improved power transmission mechanism for converting a rotating output of a driving motor into linear motion in the axial direction of the tool bit. According to the present invention, a representative reciprocating power tool may comprise a tool bit, a driving motor, a power transmission mechanism. The power transmission mechanism converts a rotating output of the driving motor into linear motion in the axial direction of the tool bit. The power transmission mechanism includes an internal gear, a planetary gear and a power transmission pin. The internal gear is allowed to rotate by a predetermined degree in relation to a load applied to the tool bit. As the result of rotation of the internal gear, the relative position of the power transmission pin is changed with respect to the point of engagement between the internal gear and the planetary gear. Thus, a linear stroke of the power transmission pin in the axial direction of the tool bit is changed.

10 Claims, 12 Drawing Sheets

RECIPROCATING POWER TOOL

BACKGROUND OF THE INVENTION

1. Field of the Invention

The present invention relates to a reciprocating power tool having a power transmission mechanism for converting a rotating output of a driving motor into linear motion in the axial direction of the tool bit.

2. Description of the Related Art

Japanese issued publication No. H4-31801 discloses an electric hammer with a starting clutch. In this hammer, clutch engagement can be controlled by means of a striker and a pusher. The striker and the pusher can slide axially within a spindle that holds a hammer bit. With this construction, even if the motor is driven, the striking element does not perform a reciprocating motion as long as the hammer bit is not pressed to the workpiece.

In the above-mentioned technique, further improvement is desired with respect to the driving mechanism of the hammer bit.

SUMMARY OF THE INVENTION

It is, accordingly, an object of the present invention to provide a reciprocating power tool having a further improved power transmission mechanism for converting a rotating output of a driving motor into linear motion in the axial direction of the tool bit.

According to the present invention, a representative reciprocating power tool may comprise a tool bit, a driving motor, a power transmission mechanism. The tool bit performs a predetermined operation on a workpiece by a reciprocating movement. The driving motor drives the tool bit. The power transmission mechanism converts a rotating output of the driving motor into linear motion in the axial direction of the tool bit. The power transmission mechanism includes an internal gear, a planetary gear and a power transmission pin. The internal gear is normally prevented from rotation. The planetary gear engages the internal gear. The power transmission pin is eccentrically disposed on the planetary gear. The internal gear is allowed to rotate by a predetermined degree in relation to a load applied to the tool bit. As the result of rotation of the internal gear in relation to the load applied to the tool bit, the relative position of the power transmission pin is changed with respect to the point of engagement between the internal gear and the planetary gear. Thus, a linear stroke of the power transmission pin in the axial direction of the tool bit is changed.

According to the representative reciprocating power tool, the stroke of the driven objects can be changed in relation to the load applied to the tool bit and thus, improved power transmission mechanism for converting a rotating output of a driving motor into linear motion in the axial direction of the tool bit can be provided.

Other objects, features and advantages of the present invention will be readily understood after reading the following detailed description together with the accompanying drawings and the claims.

BRIEF DESCRIPTION OF THE DRAWINGS

In FIG. 3, for convenience of illustration, the power transmission mechanism is shown in plan view, and the region of a connecting rod which connects an internal gear rotation control mechanism and a slide sleeve is shown in bottom view.

In FIG. 10, for convenience of illustration, the power transmission mechanism is shown in plan view, and the region of a connecting rod which connects an internal gear rotation control mechanism and a slide sleeve is shown in bottom view.

DETAILED DESCRIPTION OF THE REPRESENTATIVE EMBODIMENT OF INVENTION

Figure 1:
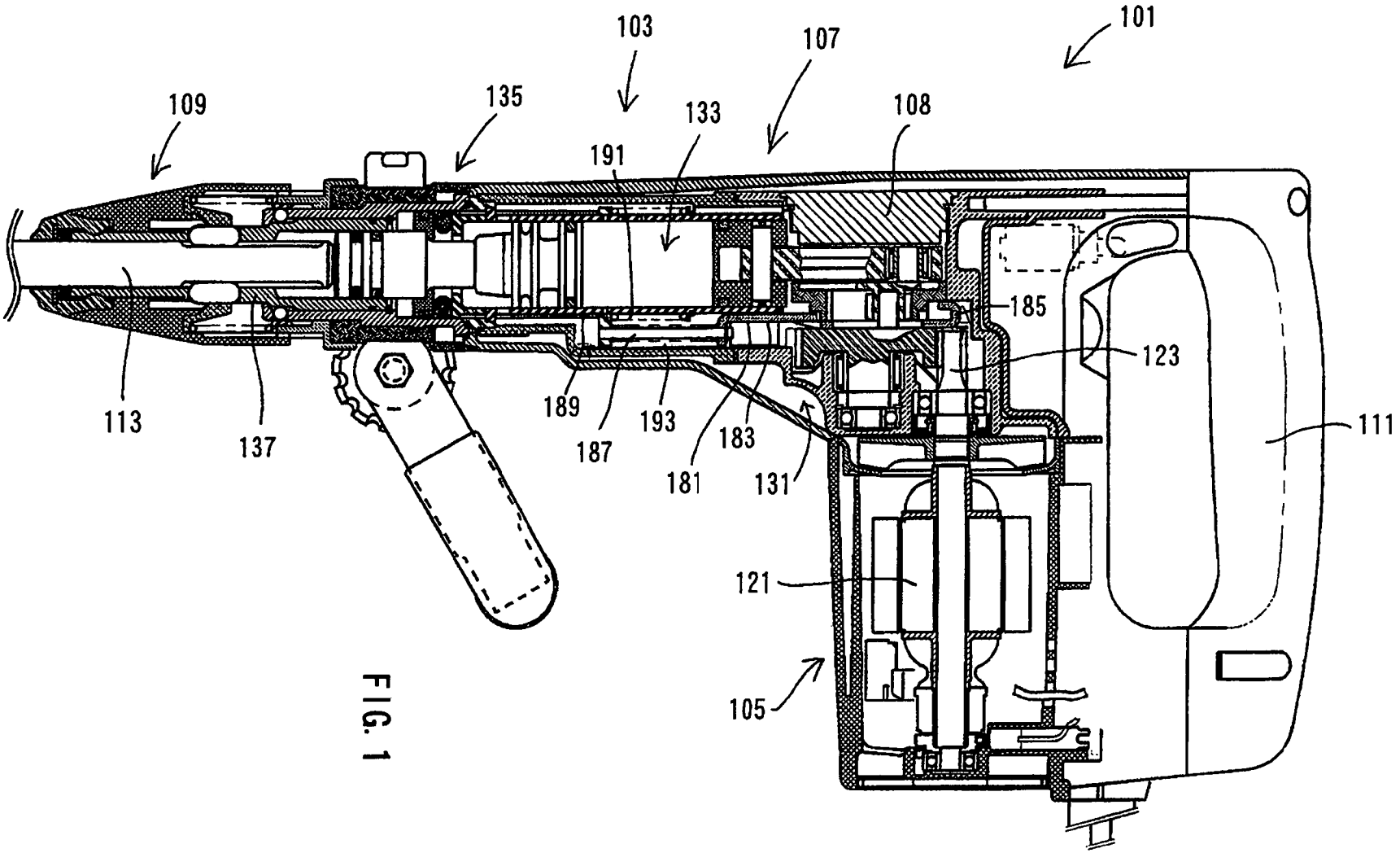
FIG. 1 is a sectional view showing an entire hammer according to a first embodiment of the invention.

According to the present invention, a representative reciprocating power tool may include a tool bit, a driving motor and a power transmission mechanism. The reciprocating power tool may preferably embrace various tools, such as hammers, hammer drills, jig saws and reciprocating saws, in which a tool bit performs a predetermined operation on a workpiece by reciprocating movement. The driving motor drives the tool bit. The power transmission mechanism serves to convert a rotating output of the driving motor into linear motion in the axial direction of the tool bit. The power transmission mechanism comprises an internal gear, a planetary gear and a power transmission pin. The internal gear is normally prevented from rotation, and the planetary gear engages with the internal gear. The power transmission pin is eccentrically disposed on the planetary gear. In the power transmission mechanism according to the present invention, a driving gear causes the planetary gear to revolve along the internal periphery of the internal gear. Thus, the power transmission pin on the planetary gear also revolves together with the planetary gear. The linear motion components in the axial direction of the tool bit within the rotating motion of the power transmission pin are utilized to transmit the power of the driving motor.

Within the power transmission mechanism according to the present invention, the power transmission pin is eccentrically disposed on the planetary gear. The internal gear is allowed to rotate by a predetermined degree in relation to a load applied to the tool bit. As a result, the relative position of the power transmission pin can be changed with respect to the point of engagement between the internal gear and the planetary gear. The state in which "the internal gear is allowed to rotate by a predetermined degree according to a load applied to the tool bit" may widely embrace the state in which the rotation of the internal gear is allowed when the load on the tool bit changes. The "load" on the tool bit embraces load applied in various directions of the tool bit, such as the circumferential direction and the axial direction of the tool bit. For example, the tool may be configured such that the internal gear is allowed to rotate when user of the tool stops pressing the tool against the workpiece in operation. Further, the state in which "the relative position of the power transmission pin is changed" widely includes the state in which the position of the power transmission pin changes with respect to the point of engagement between the planetary gear and the internal gear.

For example, the tool may be constructed such that when the planetary gear engages with the internal gear in the front end or rear end region of the internal gear in the axial direction of the tool bit, the power transmission pin is located at or near the point of such engagement. With this construction, when the planetary gear revolves along the internal periphery of the internal gear, the power transmission pin can revolve having linear motion components in the axial direction of the tool bit between the front end region and the rear end region of the internal gear. In other words, with such construction, the stroke of the linear motion components of the power transmission pin in the axial direction of the tool bit can become longer.

Otherwise, the tool may be alternatively constructed, for example, such that when the planetary gear engages with the internal gear in the front end or rear end region of the internal gear in the axial direction of the tool bit, the power transmission pin is located on the circumferential edge region of the planetary gear which is opposed to the point of such engagement. With this construction, when the planetary gear revolves along the internal periphery of the internal gear, the power transmission pin can revolve having linear motion components in the axial direction of the tool bit on the region of the planetary gear which is opposed to the above-mentioned point of engagement. With such construction, the stroke of the linear motion components of the power transmission pin in the axial direction of the tool bit can be shorter. In this case, if the diameter of the planetary gear is chosen to be about the half of the diameter of revolution of the planetary gear along the internal gear, even though the planetary gear revolves along the internal gear, the power transmission pin, which is located on the side of the planetary gear which is opposed to the point of the engagement, hardly has any linear motion component in the axial direction of the tool bit. Thus, the stroke of the linear motion components of the power transmission pin in the axial direction of the tool bit can be substantially made zero.

Thus, the relative position of the power transmission pin can be changed with respect to the point of engagement between the internal gear and the planetary gear by eccentrically disposing the power transmission pin on the planetary gear and as a result, allowing the internal gear to rotate. Such positional change can be utilized to change the linear stroke of the power transmission pin in the axial direction of the tool bit. The state in which the "linear stroke of the power transmission pin in the axial direction of the tool bit is changed" suitably includes the state in which the linear stroke becomes zero as well as the state in which it increases and decreases.

According to the present invention, the relative position of the power transmission pin may be changed in relation to the load applied to the tool bit, so that the linear stroke of the power transmission pin in the axial direction of the tool bit can be changed. Therefore, in various driving mechanisms utilizing such a linear stroke of the power transmission pin, the stroke of driven objects (objects to be driven) such as the tool bit and the counter weight can be changed. Particularly, because the stroke of the driven objects can be changed in relation to the load applied to the tool bit, the stroke of the driven objects can be changed according to the operating conditions, such as whether the tool bit is in performing operation onto the workpiece or whether the tool bit is being driven under loaded conditions or unloaded conditions. As a result, driving control in the reciprocating power tool can be efficiently achieved.

Thus, the representative mechanism can be applied to various functional elements of the reciprocating power tool. For example, such mechanism can be utilized as a starting clutch in an electric hammer and other similar power tools, if it is configured such that the stroke of the tool bit becomes zero when a load is not applied to the tool bit. Further, in this case, the tool bit can be drivingly controlled without increasing and decreasing the rotating output of the driving motor, but simply by changing the relative position of the power transmission pin. Therefore, the starting characteristics of the tool bit can be improved.

Preferably, the linear stroke of the power transmission pin in the axial direction of the tool bit may be utilized in the driving mechanism of the tool bit. Specifically, the tool bit may comprise a hammer bit that performs a hammering operation on the workpiece by receiving a striking force of a striker. Further, the power transmission pin may be connected to a crank arm that serves to drive the striker linearly in the axial direction of the hammer bit. With such construction, the relative position of the power transmission pin is changed in relation to the load applied to the hammer bit. As a result, the linear stroke of the power transmission pin in the axial direction of the hammer bit can be changed as appropriate.

Preferably, the linear stroke of the power transmission pin in the axial direction of the tool bit may be utilized in a driving mechanism for a counter weight. The counter weight may typically serve to reduce or alleviate vibration when the tool bit is driven. Specifically, the tool bit may comprise a hammer bit that performs a hammering operation on the workpiece by receiving a striking force of a striker. The power transmission pin serves to drive the counter weight that reciprocates in a direction opposite to the direction of the reciprocating motion of the striker. With such construction, the relative position of the power transmission pin can be changed in relation to the load applied to the hammer bit. Thus, the linear stroke of the power transmission pin in the axial direction of the hammer bit can be changed and the stroke of the counter weight in the hammering operation can be changed as appropriate. As a result, the performance of reducing vibration when the tool bit is driven can be changed as appropriate according to the operating conditions.

Particularly in the present invention, because the stroke of the counter weight in the hammering operation can be changed in relation to the load applied to the hammer bit, the amount of vibration reduction by the counter weight and further, the presence or absence of vibration reduction by the counter weight can be automatically controlled between the loaded driving conditions, in which a load is applied to the hammer bit, and the unloaded driving conditions, in which no load is applied to the hammer bit.

As a result, the representative reciprocating power tool may be adapted such that the internal gear is allowed to rotate in relation to a load applied to the tool bit, whereby when the planetary gear engages with the internal gear in the front end or rear end region of the internal gear in the axial direction of the tool bit, the power transmission pin is located in or near the point of such engagement.

With this construction, when the planetary gear revolves along the internal periphery of the internal gear, the power transmission pin can move linearly in the axial direction of the tool bit between the front end region and the rear end region of the internal gear. Thus, a longer stroke of the linear motion of the power transmission pin can be ensured in the axial direction of the tool bit.

Further, the representative reciprocating power tool may preferably be adapted such that the internal gear is allowed to rotate according to a load applied to the tool bit, whereby when the planetary gear engages the internal gear in the front end or rear end region of the internal gear in the axial direction of the tool bit, the power transmission pin is located on the circumferential edge region of the planetary gear which is opposed to the point of such engagement.

With this construction, when the planetary gear revolves along the internal periphery of the internal gear, the power transmission pin can move linearly in the axial direction of the tool bit in the region of the planetary gear which is opposed to the above-mentioned point of engagement. With such construction, the stroke of the linear motion components of the power transmission pin in the axial direction of the tool bit can become shorter.

Moreover, the representative reciprocating power tool may preferably be adapted such that the diameter of the planetary gear is chosen to be about the half of the diameter of revolution of the planetary gear along the internal gear.

With this construction, it can be readily arranged such that, even though the planetary gear revolves along the internal gear, the power transmission pin substantially has no linear motion components in the axial direction of the tool bit when it is located on the side of the planetary gear which is opposed to the point of the engagement. Thus, the stroke of the linear motion components can be made substantially zero.

Each of the additional features and method steps disclosed above and below may be utilized separately or in conjunction with other features and method steps to provide improved reciprocating power tools and method for using such reciprocating power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

(First Embodiment)

A representative hammer according to a first embodiment of the present invention will now be described with reference to the drawings. FIG. 1 shows an entire hammer 101 according to this embodiment. Hammer 101 is an example that corresponds to the "reciprocating power tool" according to the present invention. The hammer 101 includes a body 103 having a motor housing 105, a gear housing 107 and a handgrip 111. A hammer bit 113 is mounted to the top end (left end region as viewed in FIG. 1) of the body 103 of the hammer 101 via a hammer bit mounting chuck 109. Hammer bit 113 is a feature that corresponds to the "tool bit" according to the present invention.

The motor housing 105 houses a driving motor 121. The gear housing 107 houses a power transmission mechanism 131, an air cylinder mechanism 133 and a striking force transmission mechanism 135. A tool holder 137 for holding the hammer bit 113 is disposed within the gear housing 107 on the end (left end as viewed in FIG. 1) of the striking force transmission mechanism 135. The power transmission mechanism 131 in the gear housing 107 converts the rotating motion of an output shaft 123 of the driving motor 121 to a linear motion and transmits the converted linear motion to the hammer bit 113. Thus, the hammer bit 113 is caused to perform a hammering operation.

The tool holder 137 holds the hammer bit 113 in such a manner that the hammer bit 113 can reciprocate with respect to the tool holder 137 in its axial direction and is prevented from relatively rotate in its circumferential direction. Within the region between the right end (as viewed in FIG. 1) of the tool holder 137 and the power transmission mechanism 131, an internal gear rotation control device 181 having a first internal gear engaging portion 183 and a second internal gear engaging portion 185, a connecting rod 187, a slide sleeve 189, a slide sleeve biasing spring 191 and an engaging portion connecting spring 193 are provided. These members are used to convert an axial driving stroke in the power transmission mechanism 131, which will be described below in detail.

Figure 2:
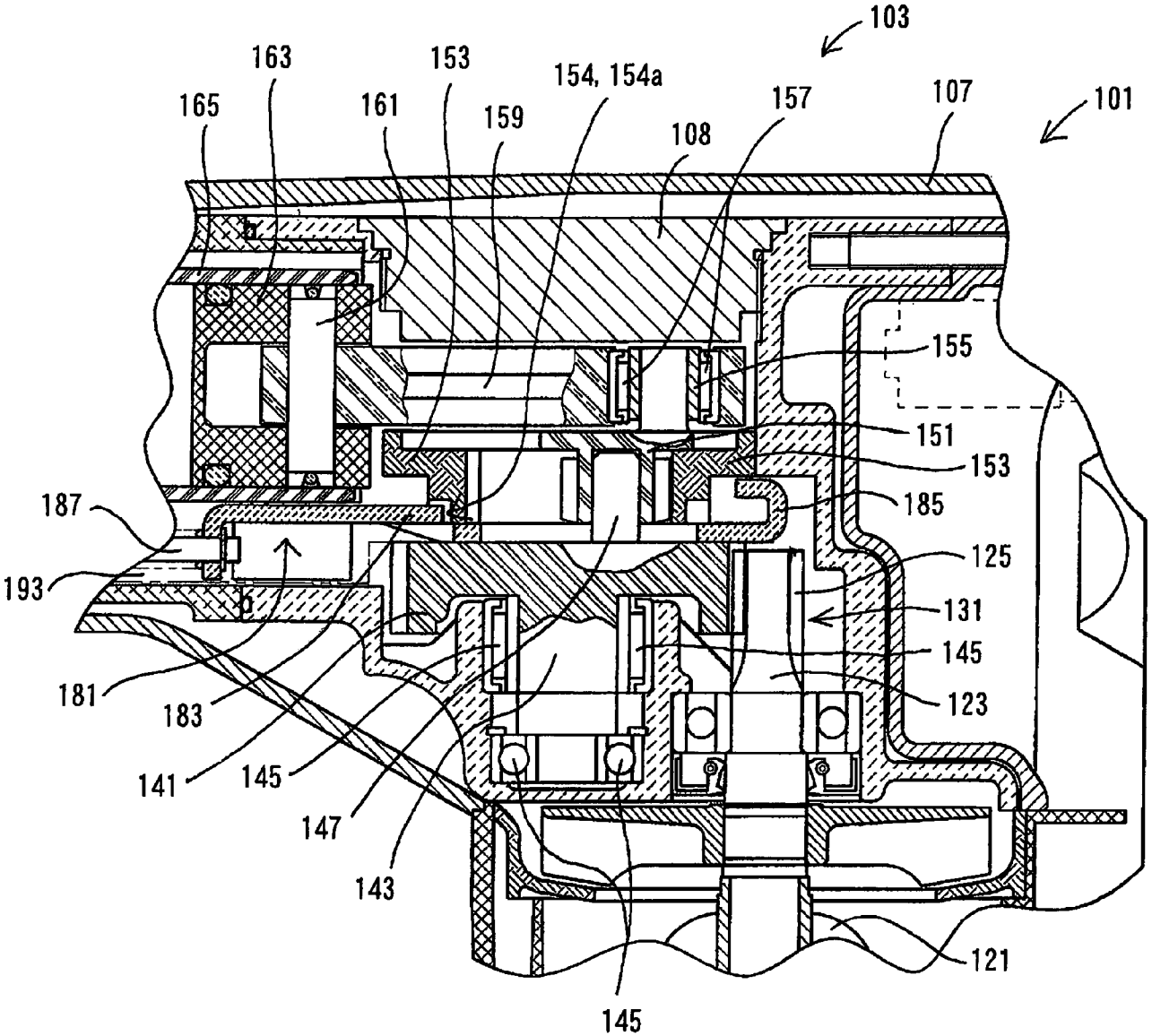
FIG. 2 is a partially broken-part, sectional view of an essential part of the hammer according to the first embodiment.

FIG. 2 shows an essential part of the hammer 101 including the power transmission mechanism 131. The power transmission mechanism 131 in the gear housing 107 includes a speed change gear 141, a gear shaft 143, a gear shaft support bearing 145 and an eccentric pin 147.

The speed change gear 141 engages a gear portion 125 of the output shaft 123 of the driving motor 121. The gear shaft 143 rotates together with the speed change gear 141. The gear shaft support bearing 145 rotatably supports the gear shaft 143. The eccentric pin 147 is integrally formed with the speed change gear 141 in a position displaced a predetermined distance from the center of rotation of the gear shaft 143.

Further, the power transmission mechanism 131 includes a planetary gear 151, an internal gear 153, a notch (recess) 154 and a crank arm driving pin 155. The planetary gear 151 is fitted on the eccentric pin 147. The internal gear 153 is disposed such that the internal teeth of the internal gear 153 engage the external teeth of the planetary gear 151. The notch 154 is formed in the outer circumferential portion of the internal gear 153 and can engage with the internal gear rotation control device 181. The crank arm driving pin 155 is integrally and eccentrically formed on the speed change gear 141. Normally, the internal gear 153 allows the planetary gear 151 to revolve along the internal periphery of the internal gear in meshing engagement, while the internal gear itself is prevented from rotating.

In this embodiment, the outer teeth diameter of the planetary gear 151 is chosen to be about the half of the diameter of revolution of the planetary gear 151 along the internal gear 153. The crank arm driving pin 155 is connected to one end of a crank arm 159 via a support bearing 157. The other end of the crank arm 159 is connected to a driver 163 via a connecting pin 161. The driver 163 is disposed within a bore of a cylinder 165 that forms the air cylinder mechanism 133 (see FIG. 1). The crank arm driving pin 155 is a feature that corresponds to the "power transmission pin" according to the present invention.

Driver 163 slides within the cylinder 165 so as to linearly drive a striker, which is not shown, by a so-called air spring function. As a result, the driver 163 generates impact loads upon the hammer bit 113 as shown in FIG. 1.

Representative hammer 101 according to this embodiment is constructed as described above. Operation and usage of the hammer 101 will now be explained. First, operation under loaded driving conditions, or, in the driving mode in which a load is applied on the hammer bit 113 of the hammer 101 shown in FIG. 1 by pressing it against the workpiece, will now be explained with reference to FIGS. 1 and 3.

Under loaded driving conditions, the slide sleeve 189 moves rightward as viewed in the drawings against a biasing force of the slide sleeve biasing spring 191 by the reaction force against the hammer bit 113 pressed to the workpiece. The slide sleeve 189 is connected to the internal gear rotation control device 181 via the connecting rod 187. The engaging portion connecting spring 193 is fitted around the connecting rod 187. When the slide sleeve 189 moves rightward (as viewed in the drawings) by the pressing force applied to the hammer bit 113, the internal gear rotation control device 181 also moves rightward. Then, the first engaging portion 183 of the internal gear rotation control device 181 engages with a notch 154*a* of the internal gear 153, thereby preventing rotation of the internal gear 153.

Figure 3:
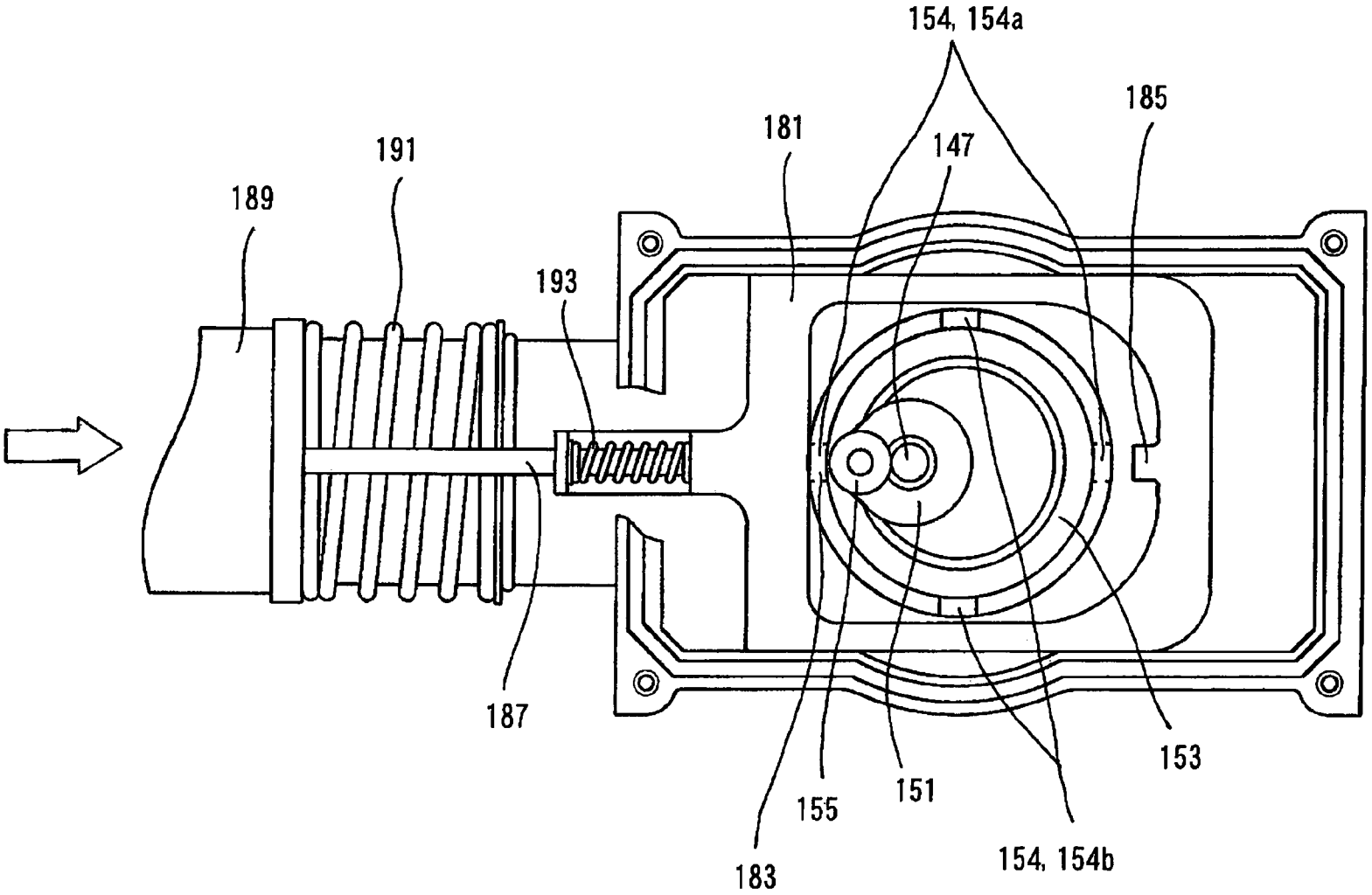
FIG. 3 shows the construction of a power transmission mechanism under loaded driving conditions.

In this state, the crank arm driving pin 155 is located near the point of engagement of the planetary gear 151 with the internal gear 153. When the eccentric pin 147 revolves along the internal periphery of the internal gear 153, the planetary gear 151 also revolves as shown in FIGS. 4 to 8 in sequence. For convenience of illustration, the point of engagement between the planetary gear 151 and the internal gear 153 in FIG. 3 is shown displaced 180 degrees from that in FIG. 4.

Figure 4:
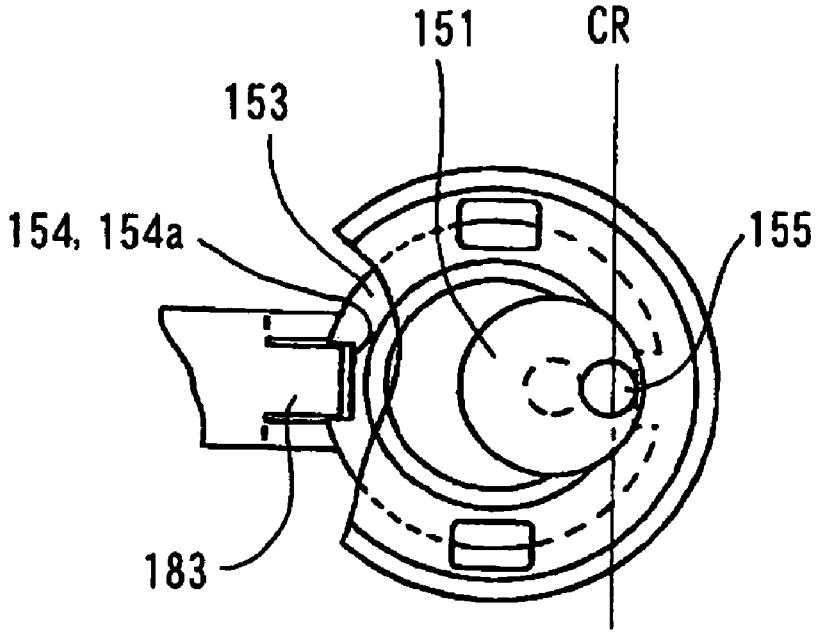
FIGS. 4 to 8 respectively show partially broken-part, plan views of state of revolution of a planetary gear under loaded driving conditions.
Figure 5:
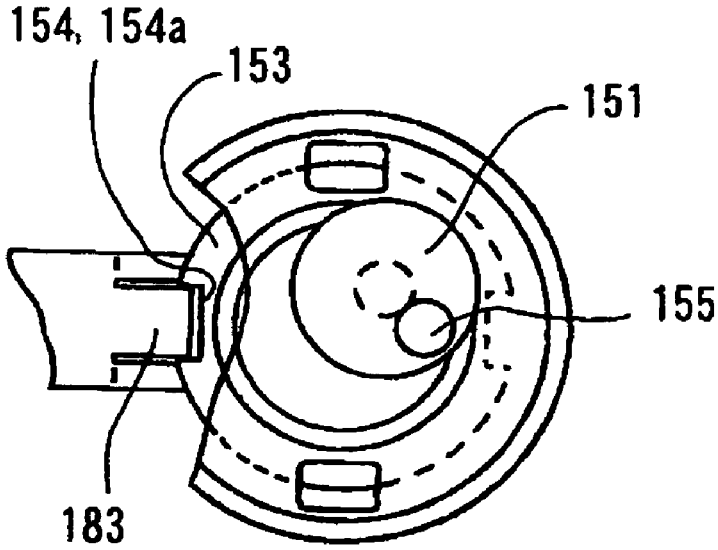
Figure 6:
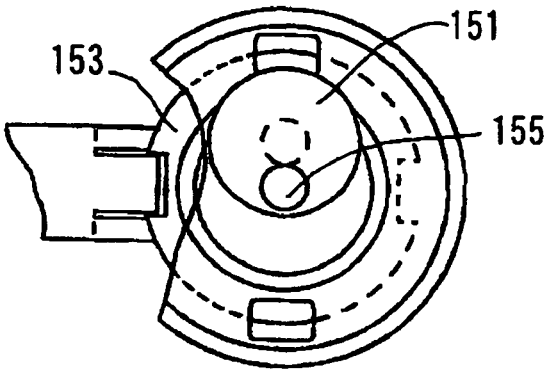
Figure 7:
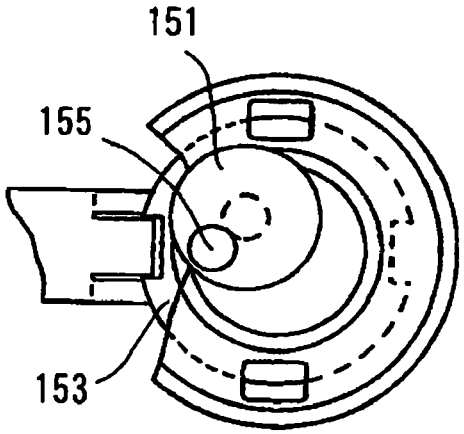
Figure 8:
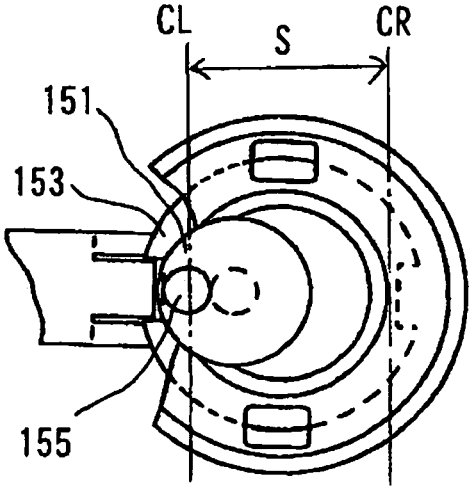

FIG. 4 shows the state in which the planetary gear 151 engages the right end portion of the internal gear 153. At this time, the crank arm driving pin 155 is located in the most rightward position (as viewed in the drawings). The center line of the crank arm driving pin 155 in this state is shown by line CR. The planetary gear 151 then revolves with respect to the internal gear 153 as shown in FIGS. 5 to 8 in sequence. In FIG. 8, the crank arm driving pin 155 is located in the most leftward position. The center line of the crank arm driving pin 155 in this state is shown by line CL.

Under loaded driving conditions, as will be understood from comparison between FIG. 4 and FIG. 8, when the planetary gear 151 revolves along the internal periphery of the internal gear 153, the crank arm driving pin 155, which is eccentrically provided on the planetary gear 151, has a linear stroke S (see FIG. 8) in the axial direction of the hammer 101 (rightward and leftward as viewed in the drawings). By utilizing the linear stroke, the crank arm 159 as shown in FIG. 2 is driven in the axial direction. Then, the driver 163, which is loosely fitted on the other end of the crank arm 159 via the connecting pin 161, reciprocates within the bore of the cylinder 165. As a result, the hammer bit 113 (see FIG. 1) is driven for hammering operation in the axial direction.

Figure 9:
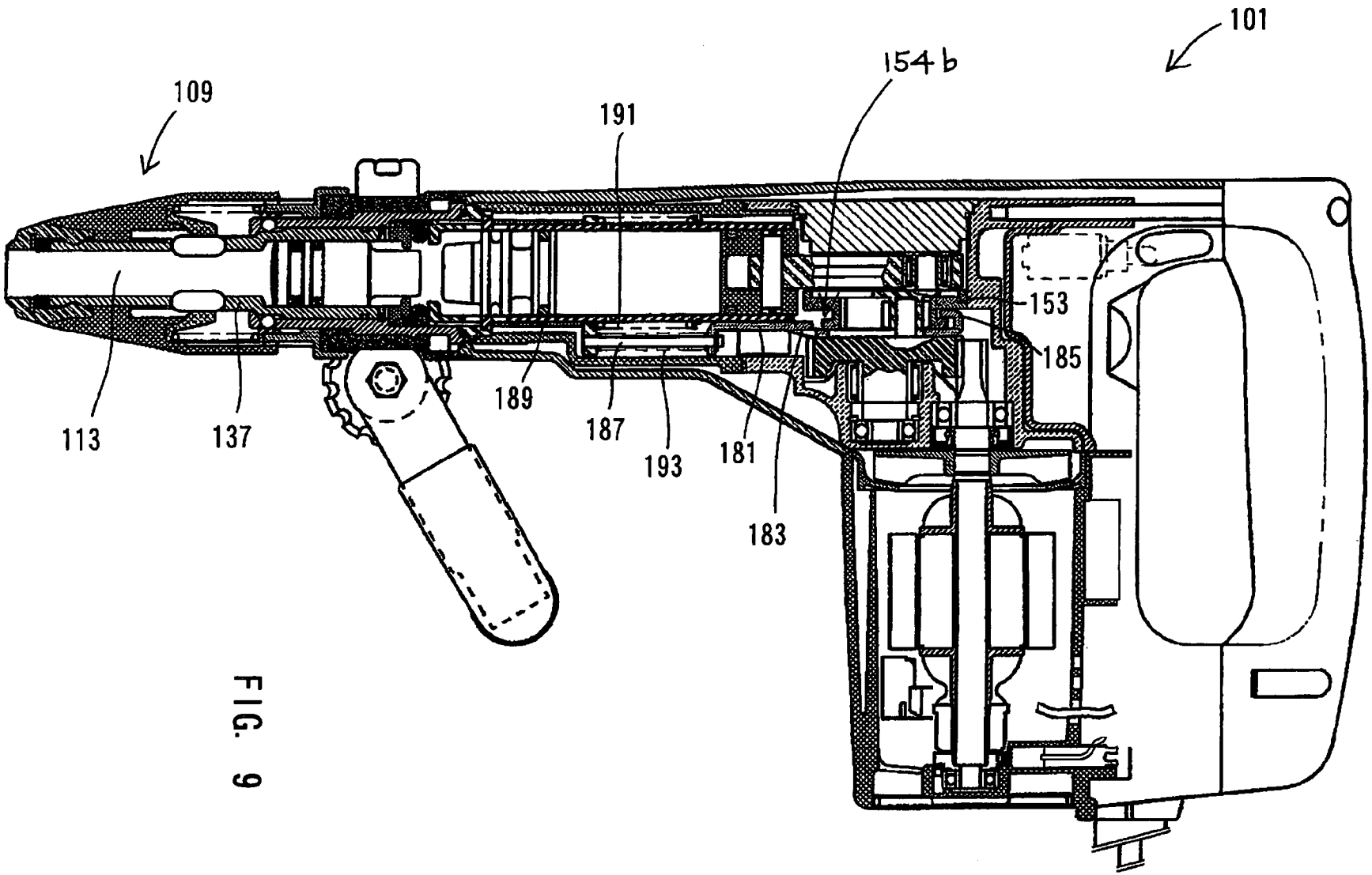
FIG. 9 is a sectional view showing the hammer according to the first embodiment under unloaded driving conditions.
Figure 10:
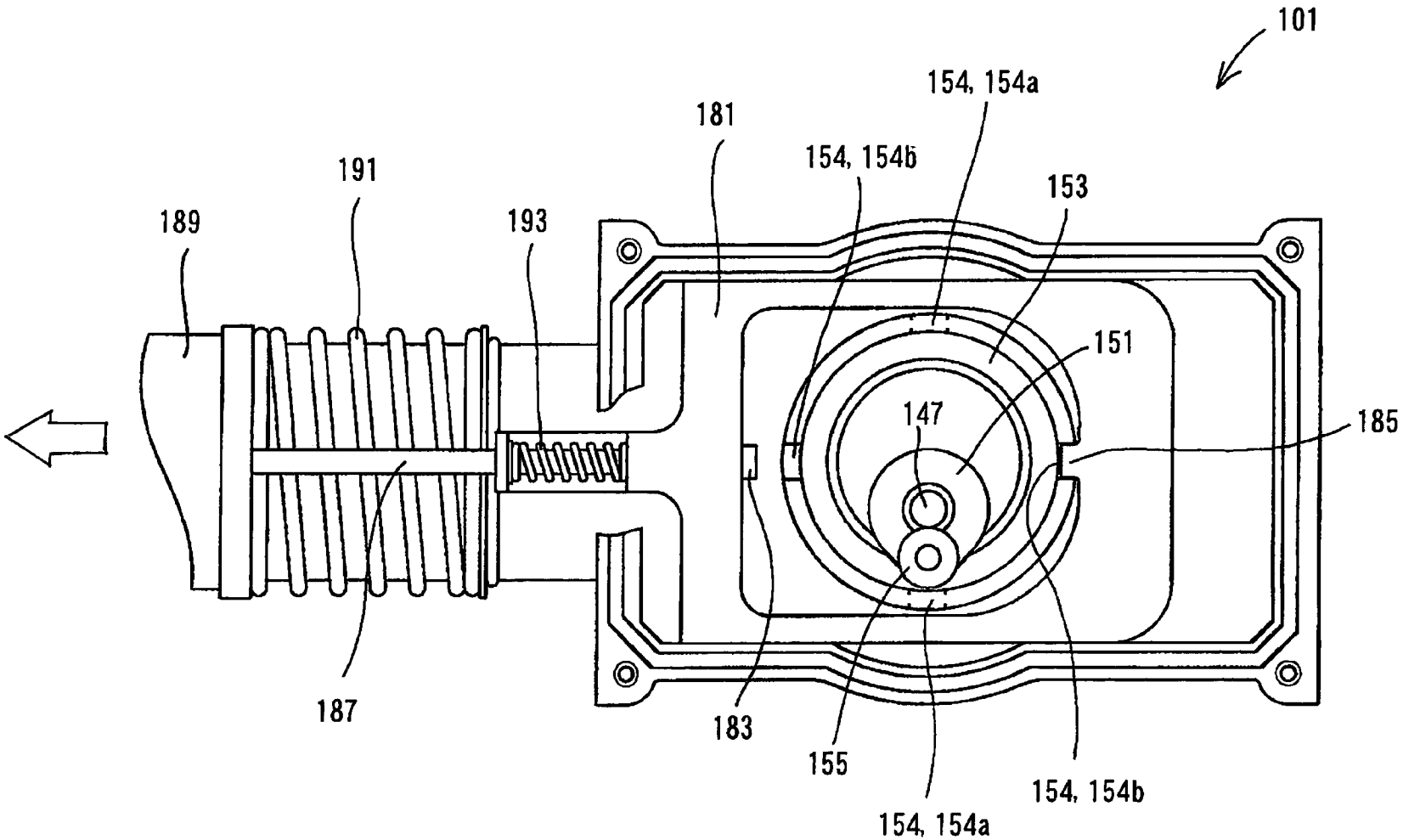
FIG. 10 shows the construction of a power transmission mechanism under unloaded driving conditions.

Next, operation under unloaded driving conditions or in the driving mode in which no load is applied to the hammer bit 113 will now be explained with reference to FIGS. 9 and 10. Under unloaded driving conditions, the reaction force is not generated against the hammer bit 113 pressing against the workpiece. Therefore, the slide sleeve 189 moves leftward as viewed in the drawings by the biasing force of the slide sleeve biasing spring 191. Thus, the internal gear rotation control device 181, which is connected to the slide sleeve 189 via the connecting rod 187, moves leftward.

The first engaging portion 183 of the internal gear rotation control device 181 then disengages from the notch 154*a* of the internal gear 153. At the instant of such disengagement of the first engaging portion 183, the internal gear 153 rotates by the torque of the speed change gear 141 (FIG. 2) having been applied to the internal gear 153 via the planetary gear 151. In this embodiment, the internal gear 153 rotates 90 degrees until the second internal gear engaging portion 185 engages a notch 154*b* of the internal gear 153 as shown in FIG. 10.

Figure 11:
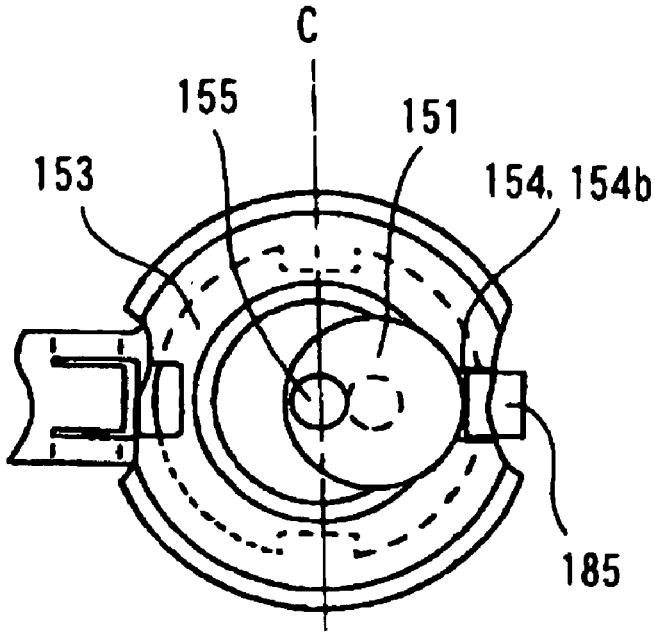
FIGS. 11 to 15 respectively show partially broken-part, plan views of state of revolution of the planetary gear under unloaded driving conditions.
Figure 12:
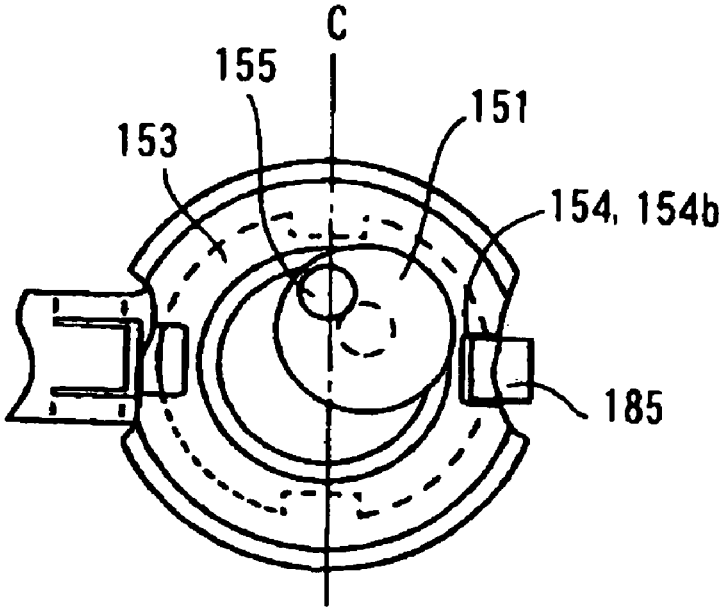
Figure 13:
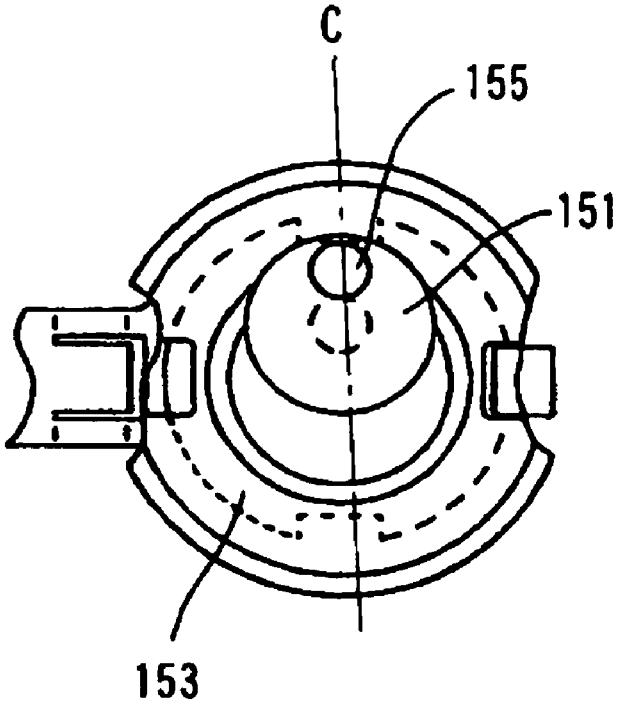
Figure 14:
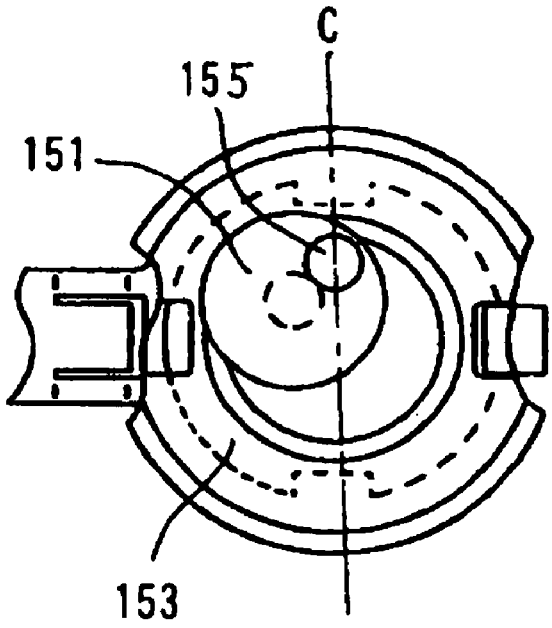

As a result, the relative position of the crank arm driving pin 155 changes with respect to the point of engagement between the planetary gear 151 and the internal gear 153. From such a changed state, when the eccentric pin 147 revolves along the internal periphery of the internal gear 153, the planetary gear 151 also revolves with respect to the internal gear 153 as shown in FIGS. 11 to 15 in sequence. FIG. 11 shows the state in which the planetary gear 151 engages with the right end portion of the internal gear 153. At this time, the crank arm driving pin 155 is located on the left circumferential edge portion of the planetary gear which is diametrically opposed to the point of engagement between the planetary gear 151 and the internal gear 153. The center of the crank arm driving pin 155 in this state is shown by line C.

Figure 15:
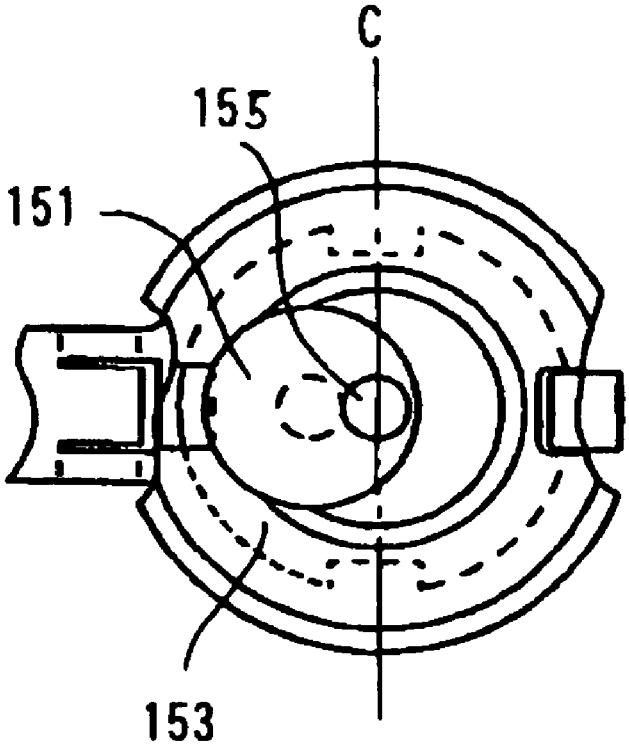

The planetary gear 151 then revolves with respect to the internal gear 153 as shown in FIGS. 12 to 15 in sequence. In FIG. 15, the planetary gear 151 engages with the left end portion of the internal gear 153. At this time, the crank arm driving pin 155 is located on the right circumferential edge portion of the planetary gear which is diametrically opposed to the point of engagement between the planetary gear 151 and the internal gear 153. The planetary gear 151 thus revolves, but, as clearly seen from comparison among FIGS. 11 to 15, the center line C of the crank arm driving pin 155 is always located at the center of the internal gear 153.

In this embodiment, the outer teeth diameter of the planetary gear 151 is chosen to be about the half of the diameter of revolution of the planetary gear 151 along the internal gear 153. Even though the planetary gear 151 revolves along the internal gear 153, the apparent stroke of the crank arm driving pin 155, which is located on the side diametrically opposed to the point of engagement between the planetary gear 151 and the internal gear 153, is zero in the axial direction of the hammer 101.

As a result, under unloaded driving conditions, even if the planetary gear 151 revolves along the internal periphery of the internal gear 153, the crank arm driving pin 155 does not move in the axial direction of the hammer 101 (rightward and leftward as viewed in the drawings). In other words, under unloaded driving conditions, even though the driving motor 121 is driven and the planetary gear 151 revolves along the internal periphery of the internal gear 153, the crank arm driving pin 155 cannot drive the crank arm 159 in the axial direction of the hammer 101. Thus, the hammer driving force is not transmitted to the hammer bit 113.

Hammer 101 according to the present embodiment is configured to have a function of a starting clutch that the output of the driving motor is transmitted to the hammer bit 113 by switching from the unloaded driving mode to the loaded driving mode.

According to this embodiment, the internal gear 142 is allowed to rotate in relation to the load applied to the hammer 113. The relative position of the crank arm driving pin 155 changes with respect to the point of engagement between the planetary gear 151 and the internal gear 153. Thus, the linear stroke of the crank arm 159 can be changed, so that the hammer bit 113 can be efficiently drivingly controlled in the hammer 101.

(Second Embodiment)

Figure 16:
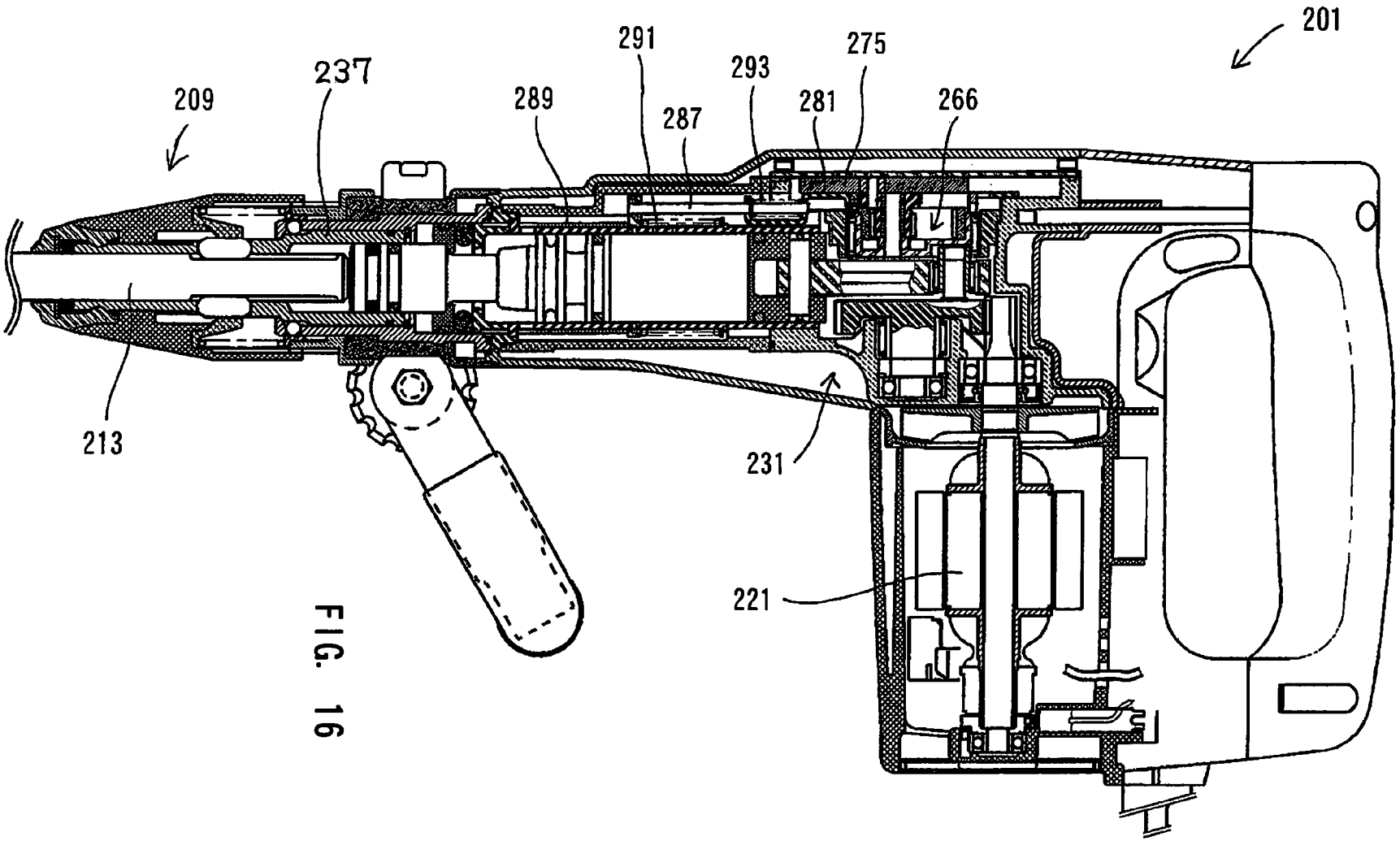
FIG. 16 is a sectional view showing an entire hammer according to a second embodiment of the invention.
Figure 17:
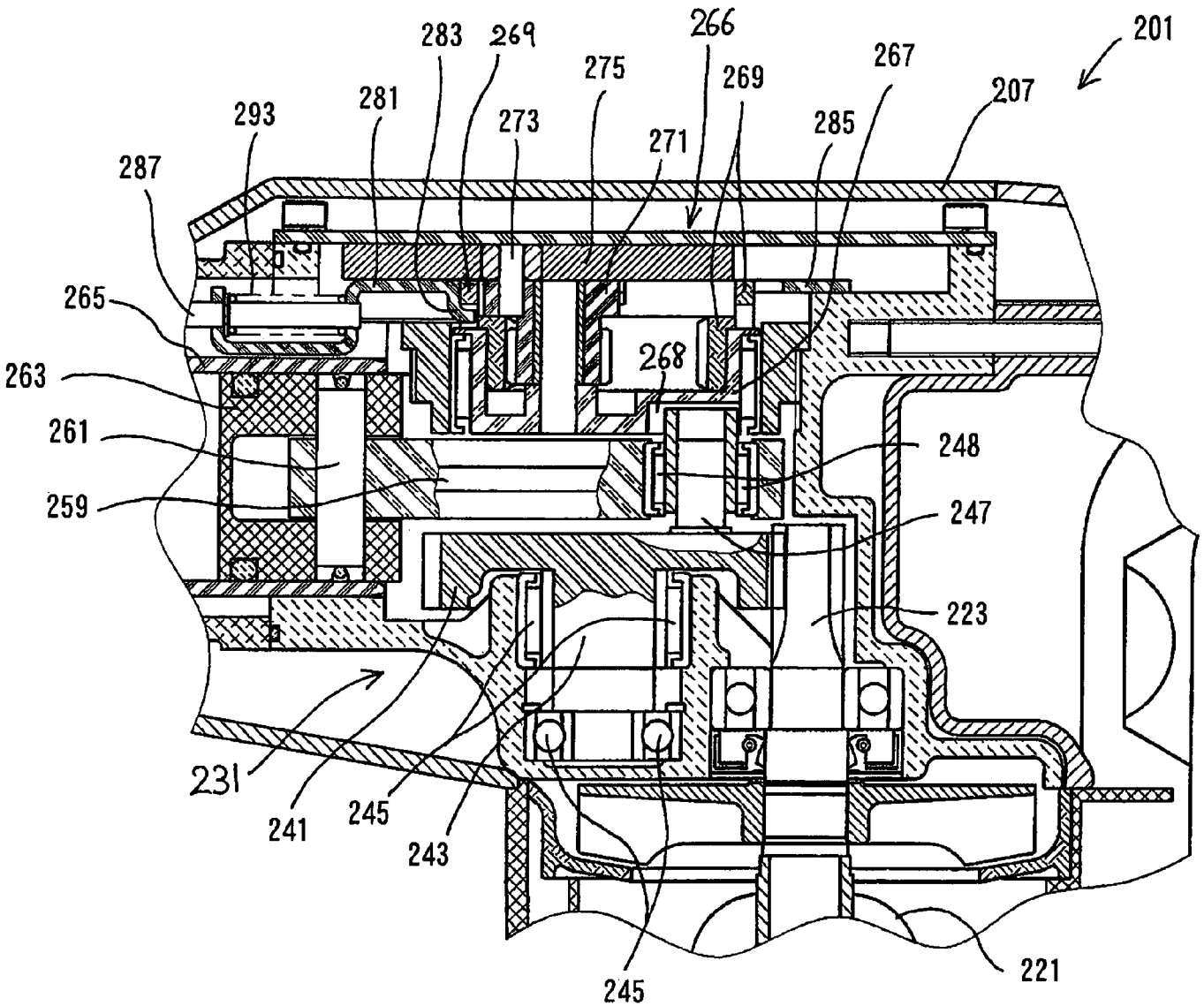
FIG. 17 is a partially broken-part, sectional view of an essential part of the hammer according to the second embodiment.

A representative hammer 201 according to a second embodiment of the present invention is shown in FIGS. 16 and 17. In the hammer 201, the above-mentioned characteristic elements of the power transmission mechanism 131 are used not to drivingly control the crank arm 159, but to drivingly control a counter weight that serves to reduce and alleviate the vibration of a striker driven by the crank arm 159. Therefore, components and elements having the same effect as in the first embodiment will not be described below in detail.

The representative hammer 201 comprises a driving motor 221, a power transmission mechanism 231 and a counter weight driving device 266 for driving a counter weight 275. The power transmission mechanism 231 transmits the rotating output of the driving motor 221 to a hammer bit 213 that is coupled to a hammer bit mounting chuck 209.

In the region between the right end (as viewed in FIG. 16) of a tool holder 237 and the power transmission mechanism 231, an internal gear rotation control device 281, a connecting rod 287, a slide sleeve 289, a slide sleeve biasing spring 291 and an engaging portion connecting spring 293 are provided. These elements are utilized to change the stroke of the counter weight 275 that is driven by the counter weight driving device 266. These elements have substantially the same construction as the corresponding elements in the first embodiment.

FIG. 17 shows an essential part of the hammer 201 including the power transmission mechanism 231 and the counter weight driving device 266. The power transmission mechanism 231 is disposed within a gear housing 207 and includes a speed change gear 241, a gear shaft 243, a gear shaft support bearing 245 and an eccentric pin 247. The speed change gear 241 engages with an output shaft 223 of the driving motor 221. The gear shaft 243 rotates together with the speed change gear 241. The gear shaft support bearing 245 rotatably supports the gear shaft 243. The eccentric pin 247 is integrally formed with the speed change gear 241 in a position displaced by a predetermined distance from the center of rotation of the gear shaft 243. The eccentric pin 247 is connected to one end of a crank arm 259 via an eccentric pin support bearing 248. The other end of the crank arm 259 is connected to a driver 263 via a connecting pin 261. The driver 163 is disposed within a bore of a cylinder 265.

Further, the eccentric pin 247 is connected to a counter weight driving crank 267 by loosely engaging in the eccentric pin receiving recess 268. The eccentric pin 247 causes the counter weight driving crank 267 to rotate. A planetary gear 271 is eccentrically disposed in a position displaced by a predetermined distance from the center of rotation of the counter weight driving crank 267. An internal gear 269 engages with a first engaging portion 283 of the internal gear rotation control device 281 and is thus prevented from rotating. The internal gear 269 is fitted in the counter weight driving crank 267. The internal gear 269 is in contact with the counter weight driving crank 267, so that the rotation of the counter weight driving crank 267 is transmitted to the internal gear 269. However, the internal gear 269 is normally prevented from rotating by the first engaging portion 283 (or second engaging portion 283) engaging the internal gear 269. The counter weight driving crank 267 functions as a "carrier" in this embodiment.

A counter weight driving pin 273 is eccentrically disposed in a position displaced a predetermined distance from the center of rotation of the planetary gear 271. The counter weight driving pin 273 is a feature that corresponds to the "power transmission pin" according to the present invention. The upper end portion of the counter weight driving pin 273 is loosely fitted in and connected to the counter weight 275.

The representative hammer 201 according to the second embodiment is constructed as described above. Operation and usage of the hammer 201 will now be explained. Under loaded driving conditions as mentioned above, as shown in FIG. 17, the rotating output of the driving motor 221 is transmitted to the driver 263 via the output shaft 223, the speed change gear 241, the eccentric pin 247, the crank arm 259 and the connecting pin 261. Thus, the driver 263 is caused to reciprocate in the axial direction (rightward and leftward in the drawing). As a result, the hammer bit 213 (see FIG. 16) is driven for hammering operation.

Eccentric pin 247 revolves around the rotation axis of the gear shaft 243, which causes the counter weight driving crank 267 to rotate. At this time, the internal gear 269 receives the torque of the counter weight driving crank 267. However, the internal gear 269 is prevented from rotating by the first engaging portion 283 that is in engagement with the internal gear 269.

As a result, the planetary gear 271, which is eccentrically disposed on the counter weight driving crank 267, revolves along the internal teeth of the internal gear 269. Thus, the counter weight driving pin 273, which is eccentrically disposed on the planetary gear 271, revolves around the central axis of the planetary gear 271. Although it is not particularly shown, a slot is formed in the counter weight 275 and extends in the direction crossing its longitudinal direction. The counter weight 275 receives only the axial motion components of the driving pin 273 and thus moves linearly. The counter weight 275 reciprocates in a position parallel to the striker that is driven by the crank arm 259 and serves to effectively reduce and alleviate the vibration of the striker.

The relative positional relationship of the counter weight driving pin 273 with respect to the point of engagement between the planetary gear 271 and the internal gear 269 under loaded driving conditions in this embodiment substantially corresponds to the states as shown in FIGS. 4 to 8, and thus will not be described and illustrated.

Under unloaded driving conditions of the hammer 201, the reaction force is not generated against the hammer bit 213 that is pressed to the workpiece. Therefore, the slide sleeve 289 moves leftward (as viewed in FIG. 16) by the biasing force of the slide sleeve biasing spring 291. Thus, the internal gear rotation control device 281, which is connected to the slide sleeve 289 via the connecting rod 287, moves leftward in figures. Then, the first engaging portion 283 of the internal gear rotation control device 281 (see FIG. 17) disengages from the internal gear 269.

At the time of such disengagement of the first engaging portion 283, the internal gear 269 comes to rotate by the torque of the counter weight driving crank 267 having been applied to the internal gear 269. The internal gear 253 rotates 90 degrees until the second internal gear engaging portion 285 engages with a notch formed on the diametrically opposite side of the internal gear 269. As a result, the relative position of the counter weight driving pin 273 changes with respect to the point of engagement between the planetary gear 271 and the internal gear 269. Such relative positional relationship as changed under unloaded driving conditions substantially corresponds to the states shown in FIGS. 11 to 15, which were described above with respect to the first embodiment, and thus will not be described and illustrated.

Thus, under unloaded driving conditions, even if the counter weight driving crank 267 rotates and thus the planetary gear 271 revolves along the internal periphery of the internal gear 269, the counter weight driving pin 273 does not have a motion component in the axial direction of the hammer 201 (rightward and leftward as viewed in the drawings). In other words, under unloaded driving conditions, the counter weight 275 cannot be driven. In the hammer 201 according to the present embodiment, the counter weight 275 is driven by the output of the driving motor by switching from the unloaded driving mode to the loaded driving mode. Therefore, in the hammer 201 of this embodiment, the counter weight can be automatically controlled according to the driving states of the hammer 201. Thus, the vibration can be efficiently reduced and alleviated.

DESCRIPTION OF NUMERALS

101 hammer
103 body
105 motor housing
107 gear housing
108 crank cap
109 hammer bit mounting chuck
111 hand grip
113 hammer bit (tool bit)
121 driving motor
123 output shaft
125 output shaft gear portion
131 power transmission mechanism
133 air cylinder mechanism
135 striking force transmission mechanism
137 tool holder
141 speed change gear
143 gear shaft
145 gear shaft support bearing
147 eccentric pin (power transmission pin)
151 planetary gear
153 internal gear
154 notch
155 crank arm driving pin
157 crank arm driving pin support bearing
159 crank arm
161 connecting pin
163 driver
165 cylinder
181 internal gear rotation control device
183 first internal gear engaging portion (maximum stroke)
185 second internal gear engaging portion (zero stroke)
187 connecting rod
189 slide sleeve
191 slide sleeve biasing spring
193 engaging portion connecting spring
247 eccentric pin (crank arm driving pin)
248 eccentric pin support bearing
259 crank arm
261 connecting pin
263 driver
265 cylinder
266 counter weight driving device
267 counter weight driving crank
268 eccentric pin receiving recess
269 internal gear
271 planetary gear
273 counter weight driving pin (power transmission pin)
275 counter weight

The invention claimed is:

1. A reciprocating power tool comprising:

a tool bit that performs a predetermined operation on a workpiece by a reciprocating movement;

a driving motor that drives the tool bit;

a power transmission mechanism including an internal gear that is prevented from rotating under normal operation, wherein the power transmission mechanism converts a rotating output of the driving motor into linear motion in the axial direction of the tool bit;

a planetary gear that engages the internal gear;

a power transmission pin that is eccentrically disposed on the planetary gear, wherein the internal gear is allowed to rotate by a predetermined degree in relation to a load applied to the tool bit, and an internal gear rotation control device having a first gear engaging portion and a second gear engaging portion, wherein the first gear engaging portion engages a first notch of the internal gear when a load is applied to the tool bit to prevent rotation of the internal gear, and the first gear engaging portion disengages from the notch when no load is applied to the tool bit to allow the internal gear to rotate until the second gear engaging portion engages a second notch of the internal gear to prevent rotation of the internal gear, and whereby the relative position of the power transmission pin is changed with respect to the point of engagement between the internal gear and the planetary gear, so that a linear stroke of the power transmission pin in the axial direction of the tool bit is changed.

2. The reciprocating power tool as defined in claim 1, wherein the tool bit comprises a hammer bit that performs a hammering operation on the workpiece by receiving a striking force of a striker and the power transmission pin is connected to a crank arm that serves to drive the striker linearly in the axial direction of the tool bit.

3. The reciprocating power tool as defined in claim 1, wherein the tool bit comprises a hammer bit that performs a hammering operation on the workpiece by receiving a striking force of a striker and the power transmission pin serves to drive a counter weight that reciprocates in a direction opposite to the direction of the reciprocating motion of the striker.

4. The reciprocating power tool as defined in claim 1, wherein the diameter of the planetary gear is about the half of the diameter of revolution of the planetary gear along the internal gear.

5. The reciprocating power tool as defined in claim 1, wherein a load is applied to the tool bit when user of the power tool presses the tool bit to the workpiece such that the internal gear is allowed to rotate by a predetermined degree.

6. The reciprocating power tool as defined in claim 1 further comprising:

a connecting rod;

a slide sleeve connected to the internal gear rotation control device via the connecting rod, the slide sleeve moves the internal gear rotation control device in relation to a load being applied to the tool bit;

a slide sleeve biasing spring providing a biasing force against a load applied to the tool bit; and an engaging portion connecting spring fitted around the connecting rod.

7. The reciprocating power tool as defined in claim 6, wherein the slide sleeve biasing spring moves the slide sleeve and the internal gear rotation control device and the first engaging portion disengages from the first notch, when no load is applied to the tool bit.

8. The reciprocating power tool as defined in claim 1, wherein the stroke length of the tool bit becomes zero when a load is not applied to the tool bit.

9. The reciprocating power tool as defined in claim 1, wherein the power transmission pin is located at or near the point of engagement of the planetary gear and the internal gear in a front end or rear end region of the internal gear in the axial direction of the tool bit, when the first gear engaging portion engages the first notch of the internal gear.

10. The reciprocating power tool as defined in claim 1, wherein the power transmission pin is located on a circumferential edge region of the planetary gear, which is opposed to a point of engagement of the planetary gear and the internal gear in the front end or rear end region of the internal gear in the axial direction of the tool bit, when the first gear engaging portion engages the first notch of the internal gear.

* * * * *